United States Patent [19]

Fox et al.

[11] 4,285,306

[45] Aug. 25, 1981

[54] DISTRIBUTOR ENGINE MOUNTING MECHANISM

[75] Inventors: David H. Fox, Ann Arbor; Robert L. Kuhn, Dearborn; Charles C. Kostan, Canton, all of Mich.

[73] Assignee: Ford Motor Company, Dearborn, Mich.

[21] Appl. No.: 103,679

[22] Filed: Dec. 14, 1979

[51] Int. Cl.[3] ..... F02P 7/02

[52] U.S. Cl. ..... 123/146.5 A; 24/257; 123/195 A; 200/19 R

[58] Field of Search ..... 123/146.5 R, 146.5 A, 123/195 A, 195 E; 24/255 R, 256, 257; 248/503; 200/19 R

[56] References Cited

U.S. PATENT DOCUMENTS

| | | | |
|---|---|---|---|
| 2,948,940 | 8/1960 | Degener | 24/257 R |
| 3,969,614 | 7/1976 | Moyer et al. | 364/431 |
| 3,983,844 | 10/1976 | Hart | 24/257 R X |
| 4,153,030 | 5/1979 | Power et al. | 123/146.5 A |
| 4,182,940 | 1/1980 | Scussel et al. | 123/146.5 A X |
| 4,186,709 | 2/1980 | Bolles | 123/146.5 A |

FOREIGN PATENT DOCUMENTS

| | | | |
|---|---|---|---|
| 1805296 | 5/1969 | Fed. Rep. of Germany | 123/146.5 A |

OTHER PUBLICATIONS

1974 Vega Service and Overhaul Manual, p. 6Y-29.

Ford 1978 Car Shop, vol. 2, p. 23-01-2 and p. 23-01-3.

*Primary Examiner*—Tony M. Argenbright

*Attorney, Agent, or Firm*—Paul K. Godwin, Jr.; Clifford L. Sadler

[57] ABSTRACT

A mechanism molded into the base of a high voltage distributor for mating with a fixed post, wherein the mechanism mounts and retains the distributor in a fixed position on an engine housing.

8 Claims, 4 Drawing Figures

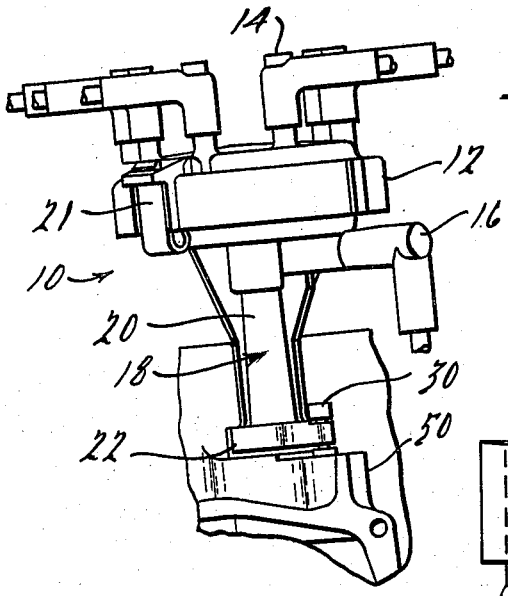
FIG. 1.
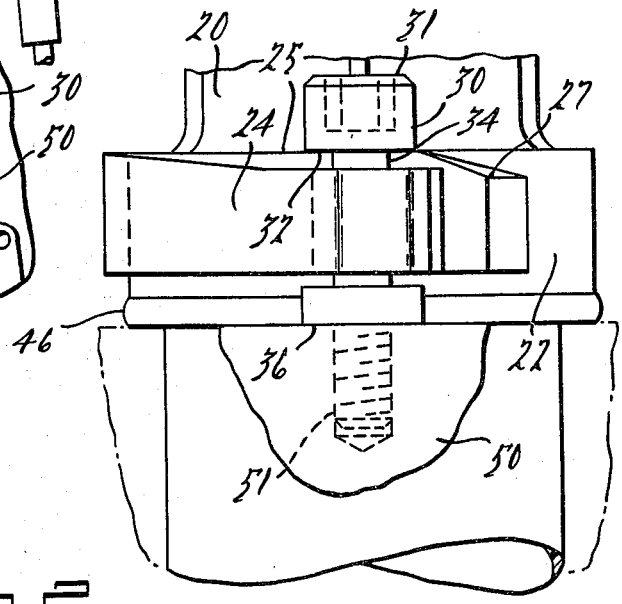
FIG. 2.
FIG. 3.
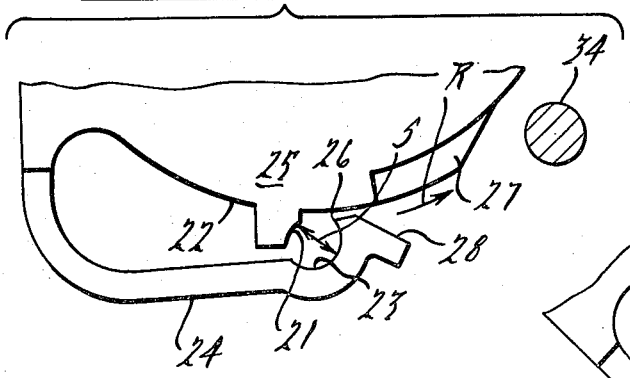
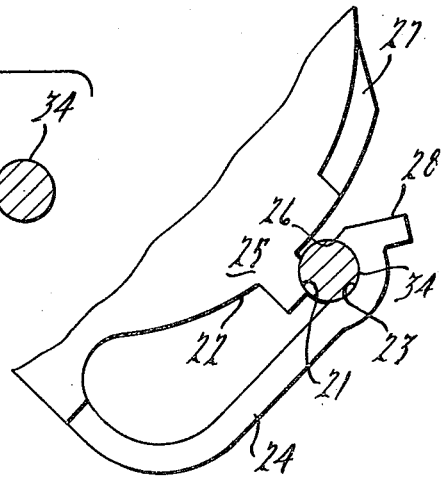
FIG. 4.

DISTRIBUTOR ENGINE MOUNTING MECHANISM

CROSS-REFERENCE TO RELATED APPLICATIONS

The subject matter disclosed herein is related to contemporaneously filed U.S. Patent Applications designated Ser. No. 103,680; Ser. No. 103,678; Ser. No. 103,677; Ser. No. 103,674; Ser. No. 103,675; Ser. No. 103,676; Ser. No. 103,673; Ser. No. 103,672; Ser. No. 103,634; and Ser. No. 103,632.

BACKGROUND OF THE INVENTION

1. Field of the Invention

The present invention is directed to the field of high voltage commutators and, more specifically, is directed to a unique mechanism for mounting an ignition distributor onto the housing of an internal combustion engine.

2. Description of the Prior Art

Conventional distributors, such as those used in association with internal combustion engines, have a collar on a lower base portion which is held in proper timing position by use of a hold down bolt and clamp arrangement. In such an arrangement, the tightened bolt forces the clamp against the collar of the distributor base to hold it in place. This conventional type of mounting mechanism is shown in the 1974 Vega Service and Overhaul Manual page 6Y-29 and the Ford 1978 Car Shop Manual, Volume 2, page 23-01-3.

In conventional ignition systems employing a primary coil timing mechanism as part of the distributor, such as that shown in FIG. 1 on page 23-01-2 of the same Ford publication, timing may be retarded or advanced by respective rotation of the distributor housing clockwise or counterclockwise. This rotation is performed by loosening the hold down belt; rotating the distributor housing; and retightening the bolt to clamp the distributor in the new timing position.

In most automotive environments, this is a particularly difficult adjustment since the hold down bolt is underneath the main body of the distributor and cannot easily be seen or reached by the mechanic performing the adjustment.

Electronic engine controls, such as that shown in commonly assigned U.S. Pat. No. 3,969,614, employ distributors that function solely as electrical commutators. Such distributors are separately located with respect to primary ignition timing assemblies and are not rotated to effect retardation or advancement of the spark to the spark plugs. Examples of commutation type distributors are shown in commonly assigned U.S. Pat. No. 4,153,030, pending U.S. patent application Ser. No. 853,698, now Pat. No. 4,182,940 filed Nov. 21, 1977 and U.S. Pat. No. 4,182,940.

SUMMARY OF THE INVENTION

It is an object of the present invention to provide an improved hold-down mechanism for an electrical commutator on an internal combustion engine.

It is another object of the present invention to provide a mounting mechanism for an electrical distributor that eliminates the need to manually loosen and tighten bolts to effect a fixed position mount.

It is a further object of the present invention to provide a distributor with an integral clamp arrangement that allows for fast and accurate installation of the distributor onto an associated internal combustion engine.

Each of the above objects are achieved in the embodiment described below. In that embodiment, a clamp arm is integrally formed as a part of the lower portion of the distributor base and is configured to mate with a post which is threaded and torqued into a corresponding threaded hole on the engine housing. After the distributor shaft is inserted into the engine opening, the distributor is rotated counterclockwise, in this instance, so that appropriately configured cam faces will cause the distributor to be pulled down towards the engine housing and at the same time open up the clamp. The opened clamp then captures and holds the post in a socket formed in the end of the clamp. Once the distributor is attached to the engine, it cannot be merely rotated clockwise and released, since the capturing socket is configured in such a way as to hook over the post and prevent slippage of the post from the socket.

BRIEF DESCRIPTION OF THE DRAWINGS

FIG. 1 is an elevational view of a distributor embodying the present invention.

FIG. 2 is a detailed elevational view of the present invention.

FIG. 3 is a top view of a clamping mechanism of the present invention in an unmounted configuration.

FIG. 4 is a top view of the clamping mechanism of the present invention after it has been rotated into a position to capture the fixed post.

DETAILED DESCRIPTION OF THE PREFERRED EMBODIMENT

In FIG. 1, the present invention is shown as embodied in an automotive distributor 10 mounted onto an engine housing 50. The distributor 10 comprises a base 18 which is molded with a shaft housing 20 and a mounting collar 22 at the extreme lower end thereof. A distributor cap 12 is shown as mounted to the base 18 with integral clips 21 (only one is shown in this figure). The cap 12 has a plurality of spark plug wires 14 attached thereto to receive high energy distribution from a rotating commutator within the distributor 10. A high voltage supply lead 16, coming from a high energy source (not shown) is attached to the socket on the base 18 to a common electrode within the distributor 10. The distributor 10 functions as a commutator to provide electrical switching between sequentially arranged spark plug wires of a particular order. The distributor 10 has particular adaptability for use with an electronic engine controls and is described in greater detail in the contemporaneously filed co-pending U.S. Patent applications identified above.

As characteristic of this type of distributor, no future adjustment to the rotational position of the distributor is necessary or desired once it is mounted onto the engine housing 50. Accordingly, the present invention provides for an easily mountable mechanism which retains the distributor in a fixed position.

A post 30 is mounted at a predetermined fixed position on the housing 50 to provide the proper orientation for the distributor 10 upon assembly. The post 30 includes a hex head socket 31 an upper shoulder portion 32, a shank portion 34 and a lower shoulder portion 36. The post is threaded into a tap 51 and is torqued so that the shoulder 36 is flush with the engine housing 50.

The present invention further comprises an integral arm 24 which, in this case, is molded as an extension of the collar 22 of a material such as 30% glass filled polyethelene terapthalate, sold under the trade name of "RYNITE 530". Due to the inherent strength of that material, the arm is resilient and molded so that the space S between a partial socket portion 23 and a partial socket portion 21 on the collar 22 is smaller than the diameter of the post which is to be clamped therein.

The socket portion 23 of the resilient arm 24, has the same radius of curvature as the shank portion 34 of the post 30. The socket portion 23 has extended curvature so that when the shank portion 34 is within the socket 23 it is captured thereby and will not slip out.

The distributor base collar 32 includes a sliding ramp surface 27 which engages the shoulder 32 of the post 30 when the distributor is turned counterclockwise to proximate its fixed position. As the distributor 10 is rotated, ramp 27 slides under the shoulder 32 and base collar 22 is pulled down towards the engine housing 50. A gasket 46 is thereby compressed to provide a seal between the distributor and the engine opening. The base collar 22 also includes a horizontal sliding surface 25 orthogonal to the axis of rotation of the distributor and abuts the shoulder 32 of the post 30 when the distributor is rotated into its fixed position.

As the distributor is being rotated towards its fixed position, the shank portion 34 engages bearing cam surface 28 at the remote end of the pre-stressed arm 24. The forcing of the bearing cam surface 28 against the shank 34 causes the arm 24 to bend outwardly away from the collar 22, as the distributor is being rotated into position. When the outer edge 26 of the socket portion 23 of the arm 24 is extended away from the collar 22 sufficiently to slide over the shank portion 34, the arm captures and clamps the shank against the receptive socket 21 on the collar 22.

As can be seen, the extreme end 26 of the socket portion 23 hooks around the shank 34 and measures a distance from the center of rotation of the distributor 10 that is shorter than the distance measured from that axis to the center of the shaft 34. Accordingly, if one were to attempt to rotate the distributor 10 clockwise in an attempt to release the connection between the distributor and the post 30, the socket 23 would continue to latch onto the shaft 34. Release is only achieved by manual separation of the socket portion 23 from the post 34.

The above described mechanism provides a dramatic improvement to conventional installation procedures by reducing the time involved as well as guaranteeing accurate positioning, when the post 34 is latched in the socket 23.

It will be apparent that many modifications and variations may be effected without departing from the scope of the novel concept of this invention. Therefore, it is intended by the appended claims to cover all such modifications and vartiations which fall within the true spirit and scope of the invention.

What is claimed is:

1. A mechanism for mounting and retaining a distributor assembly in a predetermined fixed position on an engine housing comprising:

a post mounted on said engine housing, wherein said post has a shank portion extending from said housing and an upper shoulder portion at the end of said shank remote from said housing;

means on said distributor for fixedly engaging said shank portion of said post when said distributor is rotated into said predetermined position.

2. A mounting mechanism as in claim 1, wherein said distributor further includes camming means for engaging said upper shoulder portion of said post and forcing said distributor towards said housing as said distributor is rotated into said predetermined position.

3. A mounting mechanism as in claim 2, wherein said camming means includes a first slanted planar face for engaging said upper shoulder portion of said post and a second planar surface perpendicular to the axis of rotation.

4. A mounting mechanism as in claim 1, wherein said shank engaging means includes a resilient arm, extending from said distributor, and a socket portion having a partial curvature identical to that of said shank.

5. A mounting mechanism as in claim 4, wherein said distributor also includes a receiving socket portion having a partial curvature identical to that of said shank and located opposite said arm socket portion for receiving said shank compressed thereagainst by said arm socket portion.

6. A mounting mechanism as in claim 5, wherein said resilient arm has a camming surface located adjacent said socket portion for engaging said shank portion of said post and causing said socket to move away from said distributor receiving socket as said distributor is being rotated into said predetermined position, until said shank is compressed against said receiving socket by said arm socket portion.

7. A mounting mechanism as in claim 6, wherein said resilient arm contains a means for capturing said shank when said distributor is rotated so that said shank passes said arm camming surface and into said arm socket portion.

8. A mounting mechanism as in claim 7, wherein said capturing means fixedly secures said distributor to said shank at said predetermined position and is embodied as an extension of said socket portion, past the retained center of said shank, terminating at a point measured radially from the center of the distributor roation as less than the distance from said center of rotation to the center of said shank.

* * * * *

UNITED STATES PATENT AND TRADEMARK OFFICE

CERTIFICATE OF CORRECTION

PATENT NO. : 4,285,306

DATED : August 25, 1981

INVENTOR(S) : David H. Fox et al

It is certified that error appears in the above-identified patent and that said Letters Patent are hereby corrected as shown below:

Column 1, line 56, substitute -- 4,225,759 -- for "4,182,940".

Signed and Sealed this

*Tenth* Day of *August 1982*

[SEAL]

*Attest:*

GERALD J. MOSSINGHOFF

*Attesting Officer* *Commissioner of Patents and Trademarks*